US005295291A

United States Patent [19]

Harris

[11] Patent Number: 5,295,291

[45] Date of Patent: Mar. 22, 1994

[54] CLUTCH INSTALLER AND REMOVER TOOL

[76] Inventor: Earl C. Harris, 9009 Greiner Rd., Clarence, N.Y. 14031

[21] Appl. No.: 94,776

[22] Filed: Jul. 21, 1993

[51] Int. Cl.[5] ..... B25B 27/14

[52] U.S. Cl. ..... 29/274; 29/464

[58] Field of Search ..... 29/238, 239, 259, 263, 29/266, 271, 274

[56] References Cited

U.S. PATENT DOCUMENTS

| | | | |
|---|---|---|---|
| 2,036,782 | 4/1936 | Ullmo | 29/263 |
| 2,044,818 | 6/1936 | Spase . | |
| 2,067,442 | 1/1937 | Frisz . | |
| 4,255,839 | 3/1981 | Shea . | |

*Primary Examiner*—Robert C. Watson
*Attorney, Agent, or Firm*—Robert P. Simpson

[57] ABSTRACT

A tool for centering and aligning a clutch assembly of a motor vehicle during clutch installation and removal, comprising a tripartite elongated cylindrical shaft having a threaded section at a first end of the shaft, a generally smooth cylindrical section at a second end of the shaft for mating with a pilot bearing of a crankshaft of the vehicle, and a splined section therebetween for mating with a splined throughbore of a clutch disc; and, a hollow cylindrical housing, open at one end, and having a flat circular plate at its other end, the plate having a throughbore therein to receive the threaded section of the shaft, the housing operatively arranged to surround the splined section of the shaft when the threaded section passes through the throughbore, with the open end in position to contact a surface of the clutch disc; and, a nut operatively arranged to be threaded onto the threaded section and into contact with the flat circular plate to force the open end of the housing into contact with the surface of the clutch disc, and thereafter to force the smooth cylindrical section out of mating engagement with the pilot bearing to facilitate removal of the tool from the clutch assembly.

2 Claims, 2 Drawing Sheets

CLUTCH INSTALLER AND REMOVER TOOL

BACKGROUND OF THE INVENTION

The present invention relates to a tool for installing and removing a clutch in a vehicle.

A conventional motor vehicle clutch assembly comprises a flywheel which is coupled to and driven by an engine crankshaft, a clutch disc having a splined hub axially movable on splines provided at one end of a gearbox shaft which is coaxial with the engine crankshaft, and a pressure plate attached to and rotatable with the flywheel. The pressure plate includes a strong spring which biases a friction face of the clutch disc in engagement with a corresponding friction face on the pressure plate and/or on the flywheel when the clutch is engaged, so that the clutch disc transmits drive from the drive shaft to the gearbox. When the clutch is disengaged, the spring pressure is reduced to allow the clutch disc lining to separate from the surfaces with which it is in contact. When the clutch is disengaged, the gearbox input shaft can rotate independently of the drive shaft and the gearbox is disengaged from the engine.

When installing and/or removing a clutch, it is necessary to maintain axial alignment of the flywheel, clutch disc and pressure plate, as well as radial alignment of the flywheel and pressure plate.

SUMMARY OF THE INVENTION

The present invention is a tool for centering and aligning a clutch assembly of a motor vehicle during clutch installation and removal, comprising a tripartite elongated cylindrical shaft having a threaded section at a first end of the shaft, a generally smooth cylindrical section at a second end of the shaft for mating with a pilot bearing of a crankshaft of the vehicle, and a splined section therebetween for mating with a splined throughbore of a clutch disc; and, a hollow cylindrical housing, open at one end, and having a flat circular plate at its other end, the plate having a throughbore therein to receive the threaded section of the shaft, the housing operatively arranged to surround the splined section of the shaft when the threaded section passes through the throughbore, with the open end in position to contact a surface of the clutch disc; and, a nut operatively arranged to be threaded onto the threaded section and into contact with the flat circular plate to force the open end of the housing into contact with the surface of the clutch disc, and thereafter to force the smooth cylindrical section out of mating engagement with the pilot bearing to facilitate removal of the tool from the clutch assembly.

DETAILED DESCRIPTION OF THE INVENTION

Figure 1:
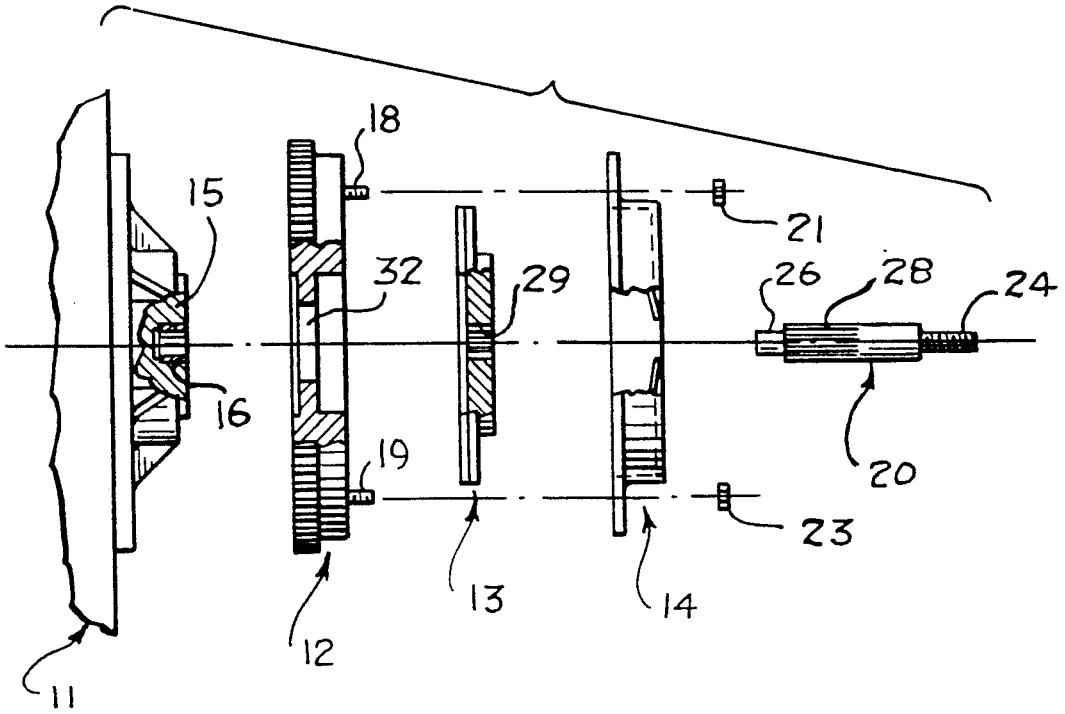
FIG. 1 is an exploded and partial cross-sectional view illustrating the engine, flywheel, clutch disc, clutch pressure plate and the installer and remover tool.

At the outset, it should be clearly understood that the drawings are to be read together with the specification, and are to be considered a portion of the entire "written description" of this invention, as required by 35 U.S.C. 112. Also, identical reference numerals on different figures refer to identical elements of this invention. As used in the following description, the terms "left" and "rightwardly" refer to orientation of the structure from the perspective of one facing FIGS. 1–4. FIG. 1 is an exploded and partial cross-sectional view of a representative clutch assembly illustrating use of the tool of the invention. The figure illustrates engine block 11, flywheel 12, clutch disc 13, clutch pressure plate 14, and installer and remover tool 20. Flywheel 12 mounts to crankshaft 15, and clutch disc 13 is sandwiched between the flywheel and pressure plate 14. The pressure plate is secured to flywheel 12 by dowels 18 and 19 and corresponding nuts 21 and 23 (additional dowels and nuts are not shown). It is Critical that the flywheel and pressure plate be radially and axially aligned, and that the flywheel, clutch disc and pressure plate be axially aligned. This is the primary purpose of tool 20. The tool holds the flywheel, clutch disc and pressure plate in place while the nuts are tightened.

As shown in FIG. 1, tool 20 is tripartite, comprising a threaded section 24 at a first end, a cylindrical section 26 at a second end, and a splined section 28 therebetween. In a preferred embodiment, for enhanced structural strength, the splines do not extend over the entire length of section 28. However, the tool would function equally well if the splines did extend over the entire length of the section. The cylindrical section 26 is adapted to mate with pilot bearing 16 of crankshaft 15. The splined section is designed to mate with the splined throughbore 29 of clutch disc 13.

Figure 2:
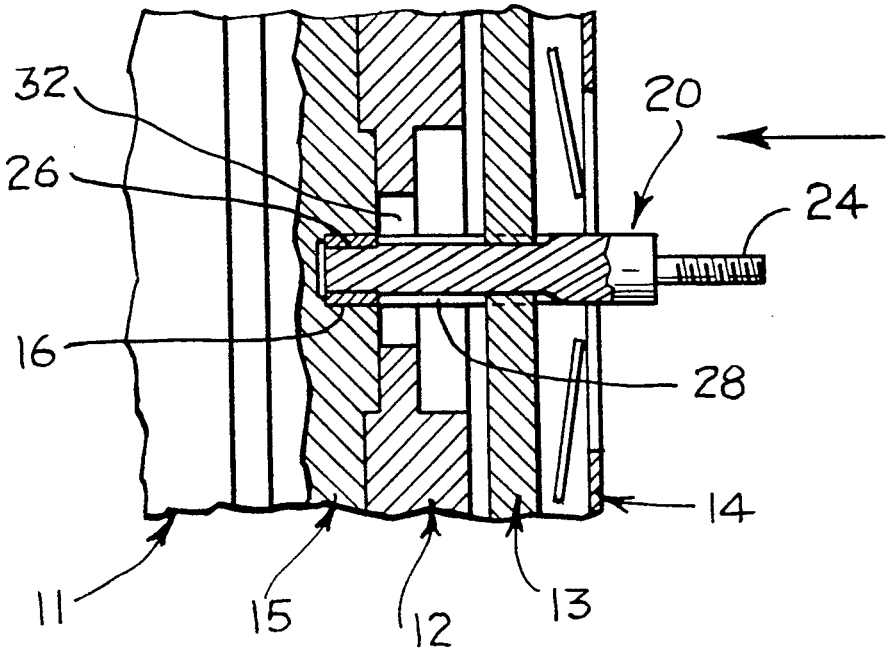
FIG. 2 is a partial cross-sectional view illustrating use of the tool of the invention to assemble the clutch assembly shown in FIG. 1.

To install the clutch assembly, tool 20 is inserted into bore 31 of pressure plate 14, and into splined bore 29 of clutch disc 13, and through bore 32 of flywheel 12, and finally into pilot bearing 16. When fully inserted, the splined section of the tool engages the splined threads of the clutch disc bore 29. The fully inserted tool is illustrated in FIG. 2.

Figure 3:
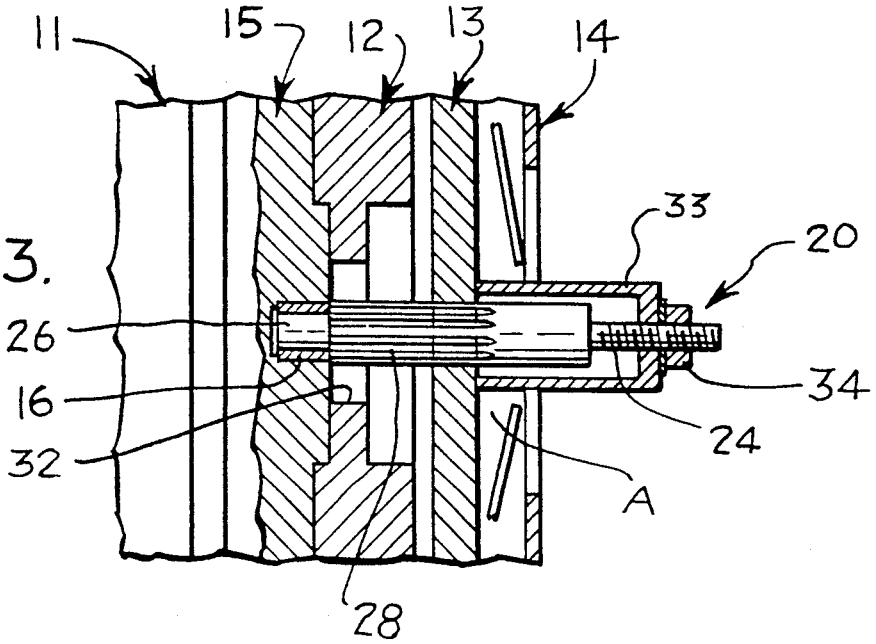
FIG. 3 is a partial cross-sectional view showing the tool of the invention with its bell cover in place in preparation for removing the tool from the assembled clutch.
Figure 4:
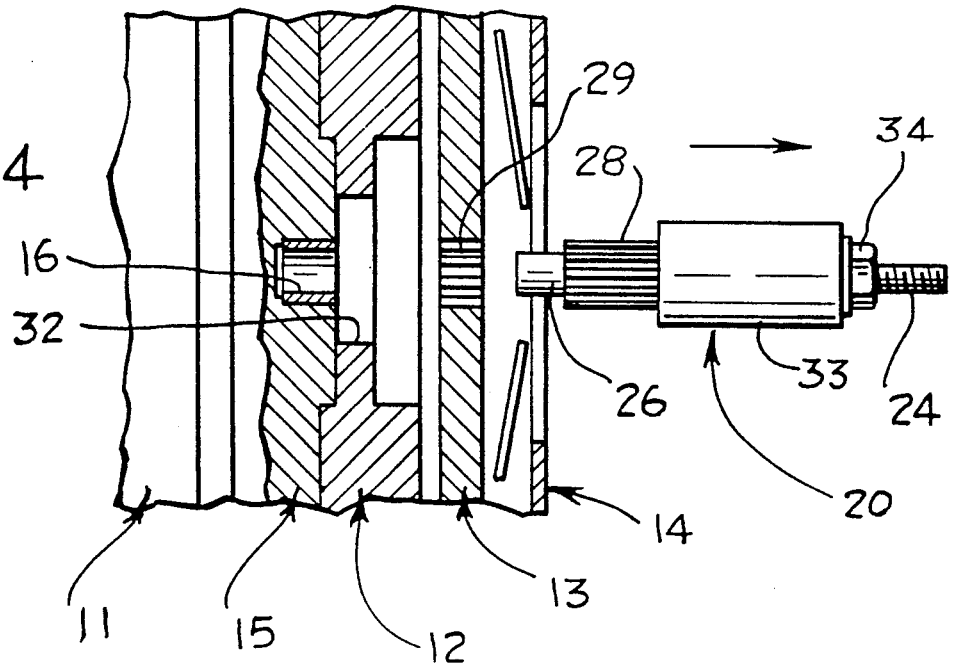
FIG. 4 is a partial cross-sectional view illustrating removal of the tool from the clutch assembly.

Removal of the tool from the assembled clutch assembly is shown in FIGS. 3 and 4. As shown in FIG. 3, the tool further includes hollow cylindrical housing 33, which is open at one end (the left end as shown in the figure) and has a flat circular plate at its other end. The flat round plate has a throughbore therein (at its center) to receive the threaded section of the tool shaft. To remove the tool, the housing is placed over the tool so that it surrounds a portion of the splined section, such that the open end of the housing comes into contact with a surface of the clutch disc. This contact area is represented as area A in FIG. 3. Nut 34 is then threaded onto threaded shaft 24. As the nut is tightened, the tool is drawn rightwardly out of the clutch assembly. FIG. 4 illustrates the direction of movement of the tool as it is removed from the clutch assembly.

While the form of apparatus herein described constitutes a preferred embodiment of this invention, it is to be understood that the invention is not limited to this precise form of apparatus, and that changes may be made therein without departing from the scope of the invention, which is defined in the appended claims.

What is claimed is:

1. A tool for centering and aligning a clutch assembly of a motor vehicle during clutch installation and removal, comprising:

a tripartite elongated cylindrical shaft having a threaded section at a first end of said shaft, a generally smooth cylindrical section at a second end of said shaft for mating with a pilot bearing of a crankshaft of said vehicle, and a splined section therebetween for mating with a splined throughbore of a clutch disc; and, a hollow cylindrical housing, open at one end, and having a flat circular plate at its other end, said plate having a throughbore therein to receive said threaded section of said shaft, said housing operatively arranged to surround said splined section of said shaft when said threaded section passes through said throughbore, with said open end in position to contact a surface of said clutch disc; and, a nut operatively arranged to be threaded onto said threaded section and into contact with said flat circular plate to force said open end of said housing into contact with said surface of said clutch disc, and thereafter to force said smooth cylindrical section out of mating engagement with said pilot bearing to facilitate removal of said tool from said clutch assembly.

2. A tool as recited in claim 1 wherein said splined section comprises splines over a fraction of said section.

* * * * *